US007461755B2

(12) United States Patent
Manera et al.

(10) Patent No.: US 7,461,755 B2
(45) Date of Patent: Dec. 9, 2008

(54) MOISTURE-TIGHT SAFETY CLOSURE AND CONTAINER HAVING A FLEXIBLE NECK FINISH

(75) Inventors: David Alan Manera, Petersburg, NJ (US); John David Buehler, Bridgeton, NJ (US); Brian Michael Gatton, Jr., Elmer, NJ (US)

(73) Assignee: Comar, Buena, NJ (US)

( * ) Notice: Subject to any disclaimer, the term of this patent is extended or adjusted under 35 U.S.C. 154(b) by 353 days.

(21) Appl. No.: 11/229,681

(22) Filed: Sep. 20, 2005

(65) Prior Publication Data

US 2007/0062900 A1 Mar. 22, 2007

(51) Int. Cl.
*B65D 53/02* (2006.01)

(52) U.S. Cl. ..... 215/344; 215/343

(58) Field of Classification Search ..... 215/47, 215/42, 40, 344, 343
See application file for complete search history.

(56) References Cited

U.S. PATENT DOCUMENTS

| | | | | | |
|---|---|---|---|---|---|
| 133,518 | A * | 12/1872 | Burnap | 215/332 |
| 1,423,560 | A * | 7/1922 | Hall | 215/40 |
| 2,099,056 | A * | 11/1937 | Ferngren | 229/5.5 |
| 3,339,770 | A * | 9/1967 | Bruno | 215/214 |
| 3,434,615 | A * | 3/1969 | Barletta | 215/276 |
| 3,716,161 | A * | 2/1973 | Julian et al. | 215/330 |
| 3,733,001 | A * | 5/1973 | Gach | 215/217 |
| 4,049,148 | A * | 9/1977 | Suhr et al. | 215/214 |
| 4,053,078 | A * | 10/1977 | Herr | 215/222 |
| 4,159,779 | A * | 7/1979 | Hedgewick | 215/214 |
| 4,319,690 | A * | 3/1982 | Birrell et al. | 215/220 |
| 4,397,397 | A * | 8/1983 | Herr | 215/211 |
| 4,444,327 | A * | 4/1984 | Hedgewick | 215/211 |
| 5,213,223 | A * | 5/1993 | Minnette | 215/216 |
| 5,240,719 | A * | 8/1993 | Hedgewick | 425/556 |
| 6,006,930 | A * | 12/1999 | Dreyer et al. | 215/44 |
| 6,227,391 | B1 * | 5/2001 | King | 215/307 |
| 6,378,713 | B2 * | 4/2002 | Montgomery | 215/222 |
| 7,017,782 | B2 * | 3/2006 | Harrold | 222/153.1 |
| 7,055,708 | B1 * | 6/2006 | Haffner et al. | 215/222 |
| 2004/0007556 | A1 * | 1/2004 | Manera et al. | 215/332 |
| 2004/0256346 | A1 * | 12/2004 | Becker et al. | 215/44 |
| 2005/0199572 | A1 * | 9/2005 | Brozell | 215/218 |

* cited by examiner

*Primary Examiner*—Anthony D Stashick
*Assistant Examiner*—Robert J Hicks
(74) *Attorney, Agent, or Firm*—James G. O'Boyle, Esq.

(57) ABSTRACT

A moisture-tight safety closure and a container wherein a depending, circumferentially extending sealing lip on the closure engages a flexible wall portion on the neck of the container. A plurality of circumferentially extending lugs on the closure cooperate with a plurality of circumferentially spaced hooks on the container neck for releasably securing the closure to the container.

3 Claims, 4 Drawing Sheets

MOISTURE-TIGHT SAFETY CLOSURE AND CONTAINER HAVING A FLEXIBLE NECK FINISH

BACKGROUND OF THE INVENTION

The moisture tight safety closure and container of the present invention is an improvement on the container closure assembly shown and described in pending U.S. patent application Ser. No. 10/444,309 filed May 23, 2003, the disclosure of which is incorporated herein by reference.

After considerable research and experimentation, it has been found that by providing a flexible neck finish on the neck of a container in lieu of a tapered finish, as disclosed in the above-noted pending application, an improved moisture-tight seal is provided when the depending sealing-like flange on the closure engages the flexible neck finish on the container.

SUMMARY OF THE INVENTION

The moisture-tight safety closure and container of the present invention comprises, essentially, a cap of cup-like form having a top wall and a cylindrical skirt portion depending therefrom. A circumferentially extending, tapered, sealing lip depends from the top wall of the cap and is spaced inwardly from the skirt.

The container has a neck provided with an axially extending annular slot to thereby form an inner wall portion and a radially outwardly spaced flexible outer wall portion.

The cap has a plurality of circumferentially spaced, radially inwardly directed lugs on the cap skirt adapted to cooperate with a plurality of circumferentially spaced slots and hooks on the neck of the container below the flexible neck finish for securing the cap on the container, wherein the sealing lip engages the flexible outer wall portion of the neck to form a moisture-tight seal.

DESCRIPTION OF THE PREFERRED EMBODIMENT

Figure 1:
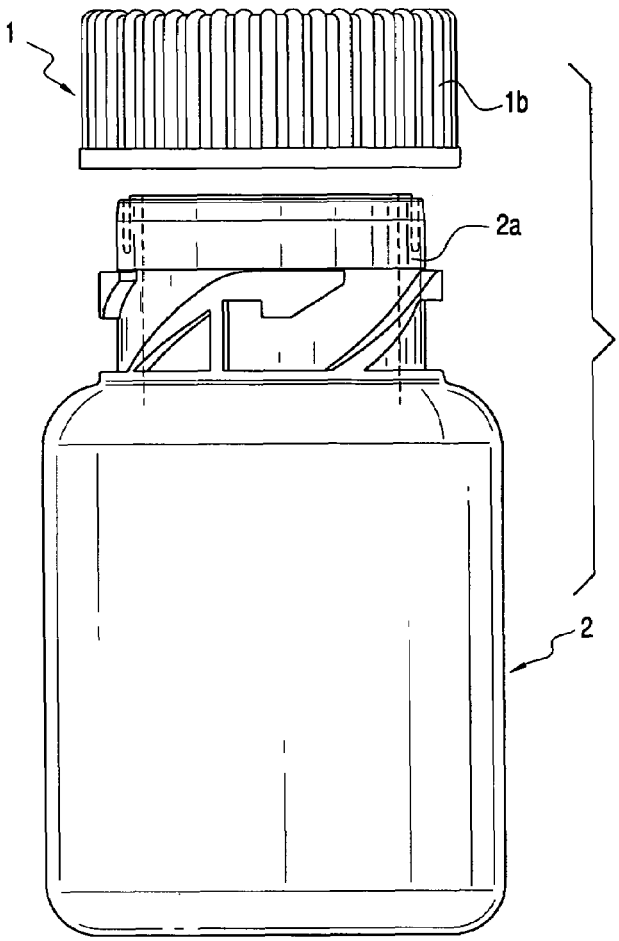
FIG. 1 is an exploded side elevational view of the container and closure.
Figure 2:
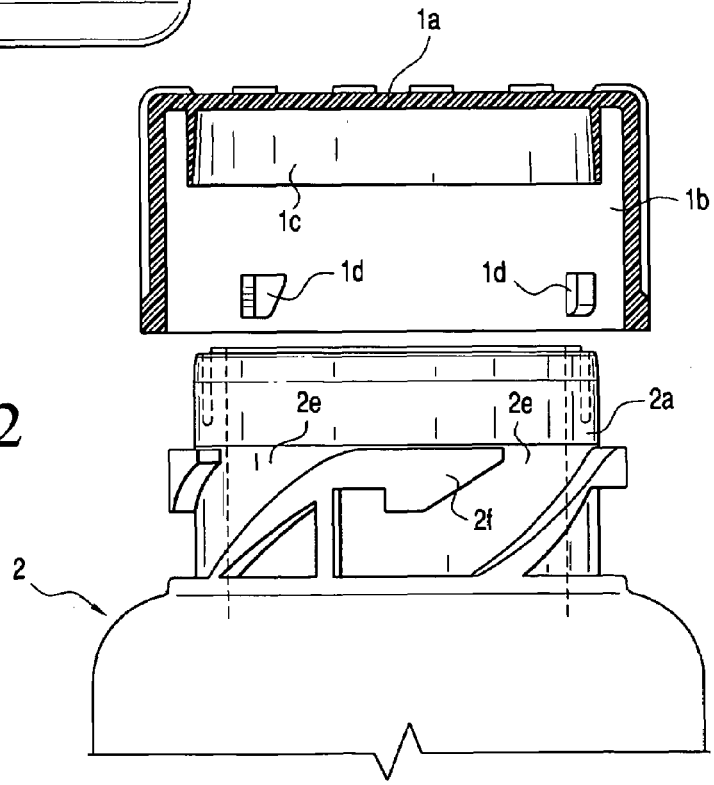
FIG. 2 is an enlarged fragmentary view of FIG. 1 showing the closure in cross-section.

Referring to the drawings and more particularly to FIGS. 1 and 2, the moisture-tight safety closure 1 and container 2 of the present invention comprises a cap of cup-like form having a top wall 1*a* and a cylindrical skirt portion 1*b* depending therefrom. A circumferentially extending, tapered flexible sealing lip 1*c* depends from the top wall 1*a* of the cap and is spaced radially inwardly from the cap skirt 1*b*.

Figure 4:
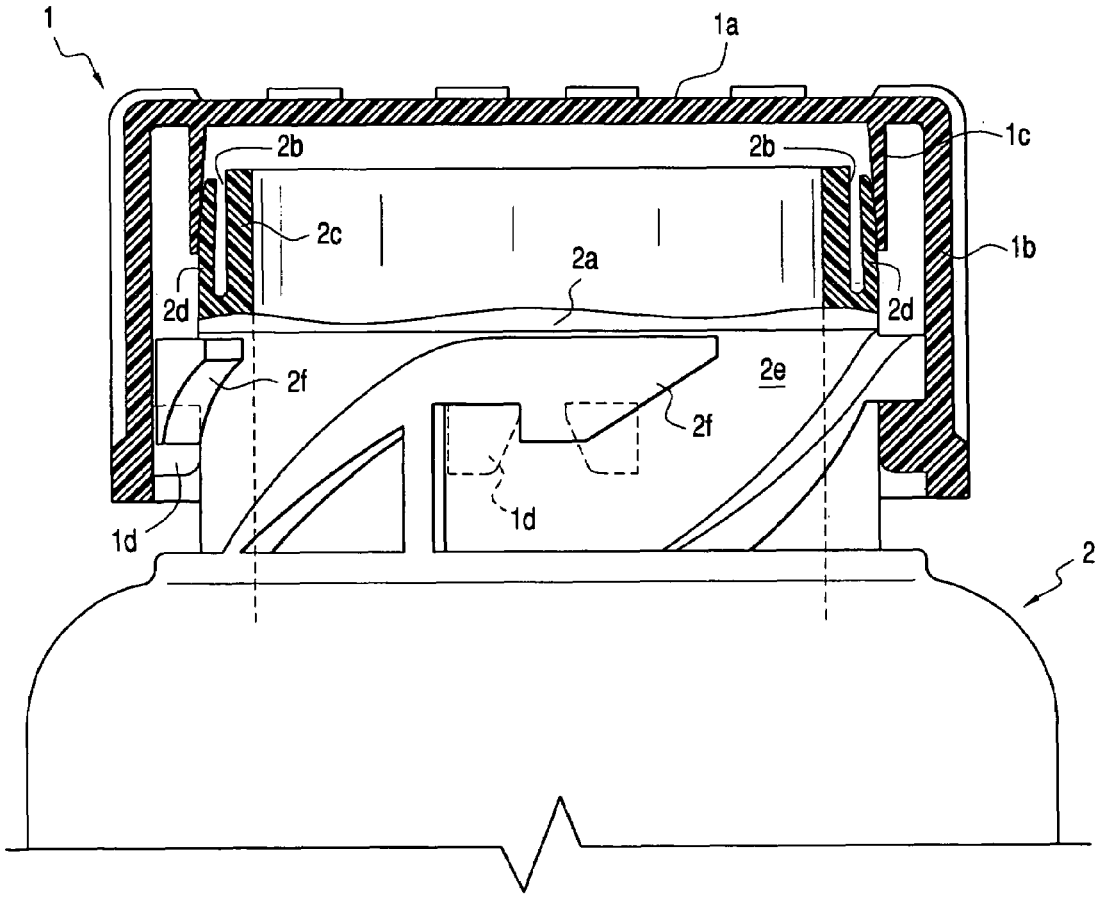
FIG. 4 is an enlarged fragmentary, partial sectional view showing the closure in the sealing position on the neck of the container.

As will be seen in FIG. 4, the neck portion 2*a* is provided with an axially extending annular slot 2*b* to thereby form an inner annular wall portion 2*c* and a radially outwardly spaced flexible annular outer wall portion 2*d*.

The cap is provided with a plurality of circumferentially spaced, radially inwardly extending lugs 1*d* on the skirt 1*c* adapted to cooperate, respectively, with a plurality of circumferentially spaced slots 2*e* and hooks 2*f* on the container neck below the flexible wall portion 2*d*.

Figure 3:
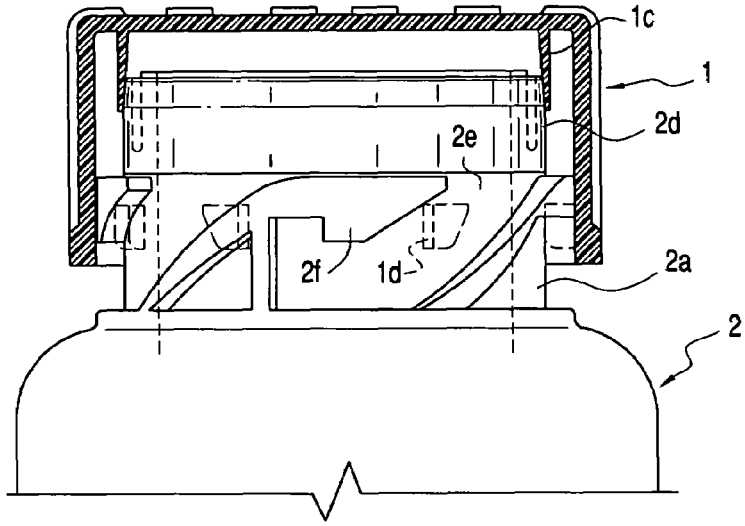
FIG. 3 is a fragmentary side elevational view showing the initial position of the closure when placed on the neck of the container.

As will be seen in FIG. 3, when the closure 1 is initially placed on the neck 2*a* of the container 2, the lower edge of the sealing lip 1*c* engages the flexible outer wall portion 2*d* at the container neck, and each lug 1*d* is positioned in a respective slot 2*e*. By rotating the closure 1 in a clock-wise direction, the lugs 1*d* are engaged by the hooks 2*f*, as shown in FIG. 4. In this position, the sealing lip 1*c* engages and flexes the outer wall portion 2*d* of the neck inwardly, thereby forming a moisture-tight seal with the container 2.

While in this position with the sealing lip 1*c* pressing against the outer wall portion 2*d*, an upward biasing force is produced seating the lugs 1*d* into locking engagement with the hooks 2*f*.

Figure 5:
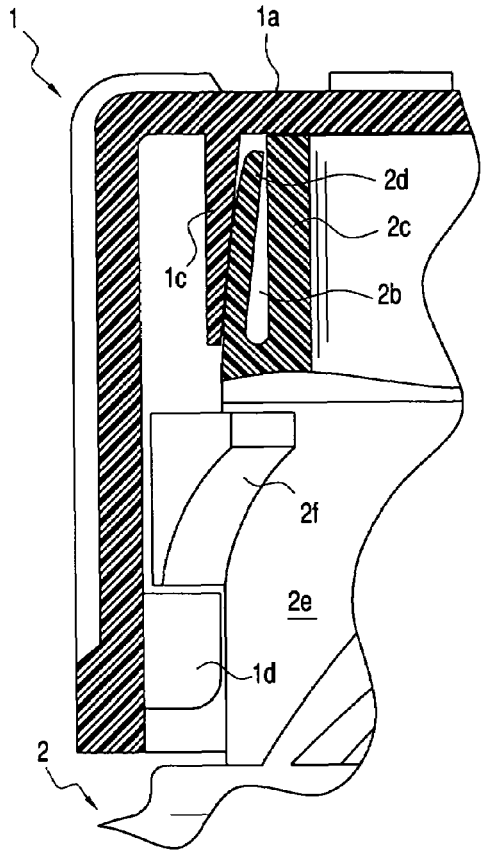
FIG. 5 is a fragmentary, partial sectional view showing the closure in the pushed down position to release the locking lugs.
Figure 6:
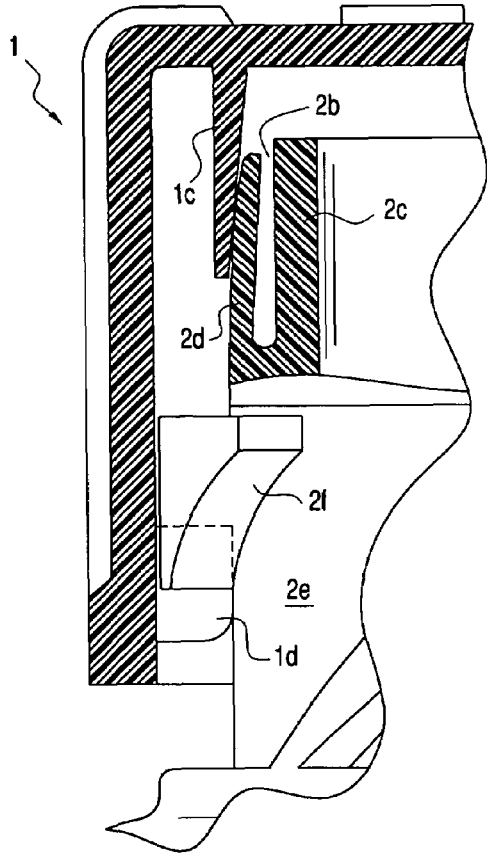
FIG. 6 is a view similar to FIG. 5 but showing the closure being removed from the container.
Figure 7:
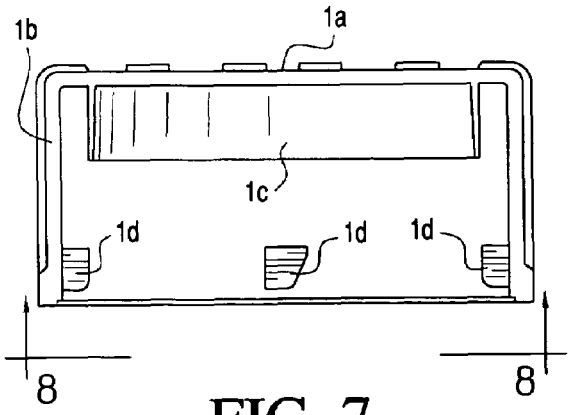
FIG. 7 is a sectional side elevational view of the closure
Figure 8:
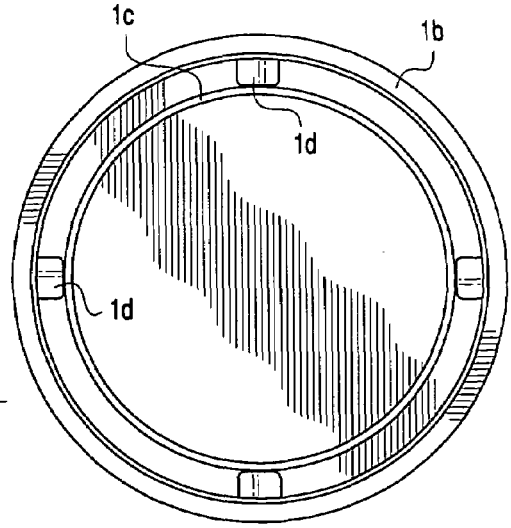
FIG. 8 is a view taken along line 8-F of FIG. 7.

To remove the closure, as will be seen in FIG. 5, the closure 1 is pushed downwardly against the upwardly biasing force of the outer wall portion 2*d*, to thereby move the lugs 1*d* away from the hooks 2*f*, whereby the closure can be turned counter -clockwise for removal thereof.

Figure 9A:
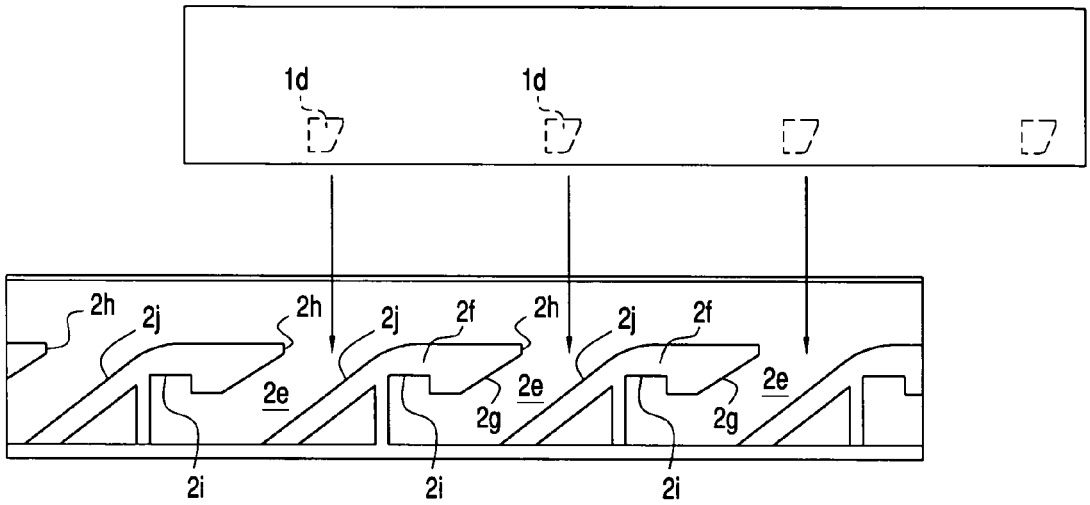
FIGS. 9A, 9B and 9C are schematic views of the relative positions of the lugs on the closure and the latches on the container neck when placing the closure on the container and turning the closure to the locked position.
Figure 9B:
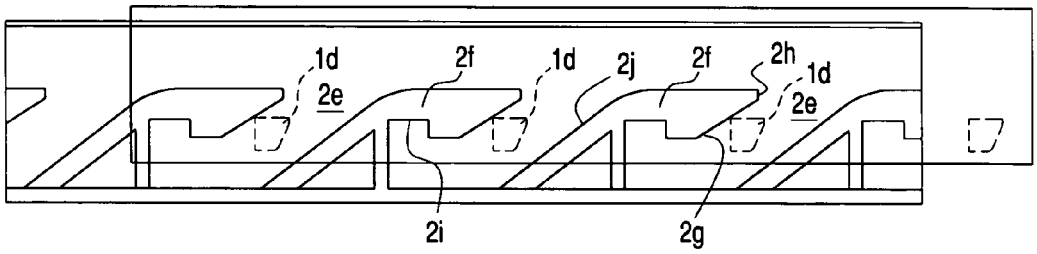
Figure 9C:
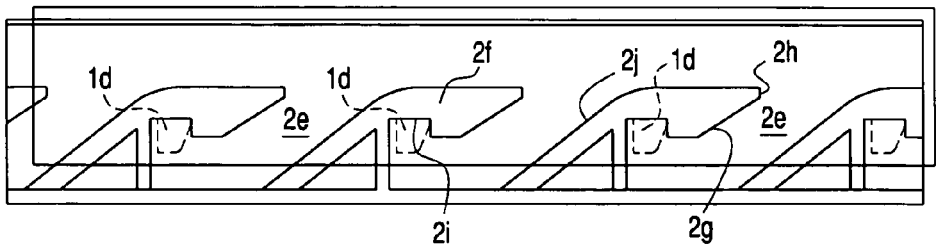

The details of the construction and arrangement of the lugs 1*d* and hooks 2*f* are illustrated in FIGS. 9A, 9B and 9C. Each hook 2*f* is provided with a downwardly tapered cam surface 2*g*, a tip portion 2*h*, a downwardly facing notched recess 2*i* and an inclined back surface 2*j*. The hooks 2*f* are spaced apart a predetermined distance wherein the cam surface 2*g* of each hook 2*f* is spaced from the inclined surface 2*j* or an adjacent hook 2*f*, to thereby form the slots 2*e*, whereby a trackway is provided between adjacent hooks 2*f* for receiving the lugs 1*d* below a plane through the tip 2*h* of the forward cam surface 2*g* as shown in FIG. 9B. In this position, the closure 1 has been placed on the container 2, as shown in FIG. 3.

By rotating the closure 1 in a clockwise direction, each lug 1*d* engages a respective hook cam surface 2*g* and slides downwardly thereon before entering the notched recess 2*i*. In this position, the closure 1 is in the moisture-tight position, as shown in FIG. 4.

To open the container, the closure 1 is pushed downwardly to the position shown in FIG. 5 to remove the lugs 1*d* from the notched recesses 21 and then rotated counter-clockwise.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. A moisture-tight closure and container comprising a cap having a top wall, a cylindrical skirt portion depending from said top wall, a circumferentially extending, tapered sealing lip depending from the top wall of said cap, said sealing lip being spaced radially inwardly from the skirt, a neck on said container, an annular upper end portion on said neck, a circumferential, axially extending annular slot coaxial with the longitudinal axis of said container provided in said upper end portion of said neck to thereby provide an inner annular wall portion and a radially outwardly spaced flexible annular outer wall portion, and means for releasably securing the cap to the container neck, whereby the sealing lip engages the outer surface of the flexible annular outer wall portion on said neck to flex only the annular outer wall portion of the neck inwardly, to thereby provide a moisture-tight closure.

2. A moisture-tight safety closure and container, according to claim 1, wherein the means for releasably securing the cap to the container neck comprises a plurality of circumferentially spaced, radially inwardly extending lugs on the cap skirt portion, and a plurality of circumferentially spaced slots and hooks on the container neck below the annular upper end portion thereof.

3. A moisture-tight safety closure and container, according to claim 2, wherein each hook element has a downwardly tapered forward cam surface, an inclined back surface and a downwardly facing notched recess communicating with said forward cam surface, said hook elements being spaced apart a predetermined distance to thereby provide said slots, whereby a trackway is provided between adjacent hook elements for receiving said lugs below a plane through the tip of the forward cam surface when the sealing lip lightly engages the flexible annular outer wall portion on the neck of the container, whereby the cap only has to be rotated to engage the lugs into the notched recesses to secure the cap to the container.

* * * * *